US006338702B1

(12) United States Patent
Jordan

(10) Patent No.: US 6,338,702 B1
(45) Date of Patent: Jan. 15, 2002

(54) EXERCISE SUPPORT BAR

(76) Inventor: Duke M. Jordan, 23 Poplar Hills, Hurricane, WV (US) 25526

( * ) Notice: Subject to any disclaimer, the term of this patent is extended or adjusted under 35 U.S.C. 154(b) by 0 days.

(21) Appl. No.: 09/606,853

(22) Filed: Jun. 29, 2000

Related U.S. Application Data

(60) Provisional application No. 60/142,017, filed on Jul. 1, 1999.

(51) Int. Cl.[7] ..... A63B 21/072

(52) U.S. Cl. ..... 482/108; 482/93; 482/139; 294/15; 294/16

(58) Field of Search ..... 482/92, 93, 106–110, 482/139; 16/422, 426, DIG. 24, DIG. 25; 294/15, 16

(56) References Cited

U.S. PATENT DOCUMENTS 4,973,050 A * 11/1990 Santoro et al. ..... 482/108
5,735,779 A * 4/1998 Lay ..... 482/93

FOREIGN PATENT DOCUMENTS

RU 2001650 * 10/1993 ..... 482/108

OTHER PUBLICATIONS

Product advertisement for Olympic Tricep Bar Available from www.bigfitness.com.

* cited by examiner

*Primary Examiner*—John Mulcahy
(74) *Attorney, Agent, or Firm*—Steptoe & Johnson PLLC

(57) ABSTRACT

An exercise support bar is disclosed having two hand grips rotatably connected to opposing sides of a means for removably securing a dumbbell, wherein the dumbbell rotates freely between the two hand grips. By allowing the dumbbell to rotate, the dumbbell maintains a natural position, i.e., a vertical position, during an exercise session. The preferred means for removably securing a dumbbell is a support block having a channel passing from the top side of the support block to the bottom side and having an opening through a front side of the support block. A T-shaped channel door is pivotally connected to the support block as a means for removably locking the channel. The channel door pivots between a closed position and an open position. The first hand grip is rotatably connected to the support block by a first shaft rotatably disposed in the first side of the support block, wherein a second hand grip is rotatably connected to the support block by a second shaft rotatably disposed in the second side of the support block. In operation, a user opens the channel door, inserts a conventional dumbbell, then pivots the channel door closed and secures it in the closed position. The user grabs the exercise support bar in both hands, having one hand on the first hand grip and a second hand on the second hand grip. Then, the user performs one or more exercises, wherein with each movement of the exercise support bar, the first and second hand grips remain in the desired position while the dumbbell freely rotates and remains in the vertical position between the hand grips.

30 Claims, 5 Drawing Sheets

EXERCISE SUPPORT BAR

CROSS REFERENCE TO RELATED APPLICATIONS

This application claims the benefit of Application No. 60/142,017, filed Jul. 1, 1999.

BACKGROUND OF INVENTION

1. Field of the Invention

This invention relates to weight-lifting and exercise equipment, and specifically, to an exercise bar for holding a dumbbell during exercise wherein the dumbbell freely rotates between two hand grips.

2. Related Art

When an individual exercises lat muscles and triceps muscle groups using a conventional dumbbell, the individual typically has to hold the dumbbell in an unnatural position, e.g., in a vertical position, due to the shape of the dumbbell and having to hold the center handle of the dumbbell. The user holds the dumbbell fixed in his/her hand and rotates the entire dumbbell with the rotation of his/her hand and arm. Therefore, when using a conventional dumbbell, the user spends extra energy and effort to lift and rotate the entire dumbbell during a workout session.

One commercially available piece of exercise equipment that attempts to solve the problems of using a conventional dumbbell to exercise the triceps (and biceps) muscle groups is the Olympic Tricep Bar ("OTB"), available from www-.bigfitness.com. The OTB is a rectangular hollow frame having two hand grips transversely disposed within the rectangular frame and two revolving barrels, wherein one revolving barrel is attached externally at each end of the rectangular frame. In operation, a user places the desired amount of free weights on each revolving barrel, then holding the two hand grips within the rectangular frame, exercises the triceps (or biceps) muscle groups. Because the barrels rotate in relation to the rectangular frame, the user does not have to lift and rotate the weights during the exercise routine. The user merely lifts the weights.

Although the OTB appears to solve the rotation problem associated with using conventional dumbbells in exercising the triceps muscle groups, there are several disadvantages with using an OTB. First, the OTB requires a user to locate two sets of equal weights, install the weight sets on, and then remove the weight sets off each revolving barrel. This is a time consuming and inconvenient requirement. A user may not be able to located two equal weight sets, e.g., two 10-lbs weights. However, once located, the user must spend the time to attach each weight to a rotating barrel, and when finished exercising, the user must spend the time to remove each weight.

Second, the OTB may pose a safety hazard if the weights are not securely installed on the rotating barrels. If the weights are loose, or a rotating barrel fails, a weight may throw the OTB off-balance or even fall off of the OTB, resulting in injury to the user or property damage.

Third, by design, the hand grips are positioned within the rectangular frame, thereby making them awkward to use. A user's hands are automatically placed close together and may scrape against the inside edges of the rectangular frame. In addition, the user must exercise with the OTB having his/her palms facing inwards, resulting in extra strain being placed on the user's wrists and forearms.

Therefore, there is a need for an exercise bar for exercising lat and triceps muscle groups that uses conventional dumbbells, provides for the quick attachment and release of a conventional dumbbell, and allows for the free rotation of the dumbbell during the exercise. There is a further need for an exercise bar that provides a secure locking mechanism for the conventional dumbbell that prevents the premature and unexpected release of the dumbbell. There is a still further need for an exercise bar that allows for the rotation of the user's hand position, thereby providing a custom fit for each user during exercising.

SUMMARY OF INVENTION

The present invention solves the problems associated with using conventional dumbbells to exercise lat muscles and triceps muscle groups by providing an exercise support bar having two hand grips being rotatably connected to opposing sides of a means for removably securing a dumbbell, wherein the dumbbell rotates freely between the two hand grips. By allowing the dumbbell to rotate, the dumbbell maintains a natural position, i.e., a vertical position, during an exercise session.

In the preferred embodiment, the exercise support bar of the present invention comprises a means for removably securing a dumbbell, a first hand grip rotatably connected to a first side of the means for removably securing a dumbbell and a second hand grip rotatably connected to a second side of the means for removably securing a dumbbell. The preferred means for removably securing a dumbbell is a support block having a channel passing from the top side of the support block to the bottom side and having an opening through a front side of the support block. A T-shaped channel door is pivotally connected to the support block as a means for removably locking the channel and locking a dumbbell in the channel. The channel door pivots between a closed position and an open position.

The first hand grip is rotatably connected to the support block by a first shaft rotatably disposed in the first side of the support block, wherein a second hand grip is rotatably connected to the support block by a second shaft rotatably disposed in the second side of the support block.

In operation, a user opens the channel door, inserts a handle of a conventional dumbbell, then pivots the channel door closed and secures it in the closed position. The user grabs the exercise support bar in both hands, having one hand on the first hand grip and a second hand on the second hand grip. Then, the user performs one or more exercises, wherein with each movement of the exercise support bar, the first and second hand grips remain in the desired position while the dumbbell freely rotates and remains in the vertical position between the hand grips.

In an alternative embodiment, the exercise support bar is generally concave in shape, having a swivel handle on each end, and in the center having a means for securing a dumbbell wherein the dumbbell can swivel in relation to the two handles. This embodiment of the exercise support bar is an elongated bar divided into three sections: first, center, and second, wherein the first and second sections are slightly bent off the horizontal axis toward the center section. This bending, or concave, nature of the exercise support bar is a more ergonomic shape for a user and allows the user to maintain a more natural position of his/her arms and hands during a workout.

The alternative exercise bar of the present invention also has hand stops located at each end of the exercise support bar that prevents the exercise support bar from slipping from the user's hand during a workout.

There are several advantages with using an exercise support bar of the present invention. First, the exercise support bar allows a user to have a natural hold on the exercise support bar while exercising as opposed to the twisting and unnatural position of the hands that occurs when using solely a conventional dumbbell to exercise lat muscles and triceps muscle groups. Second, the exercise support bar allows an individual to use any type of commercially available dumbbell, either a dumbbell on which various weights may be added/removed or a dumbbell of a fixed weight, e.g., preassembled dumbbell. Third, a dumbbell is secured to the exercise support bar via the center bar of the dumbbell, thereby leaving the two weighted ends of the dumbbell free for adjustment. Thus, a user is not limited to a specific weight on the dumbbell but can make adjustments to the weight of a dumbbell without removing the dumbbell from the exercise support bar.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

Figure 1:
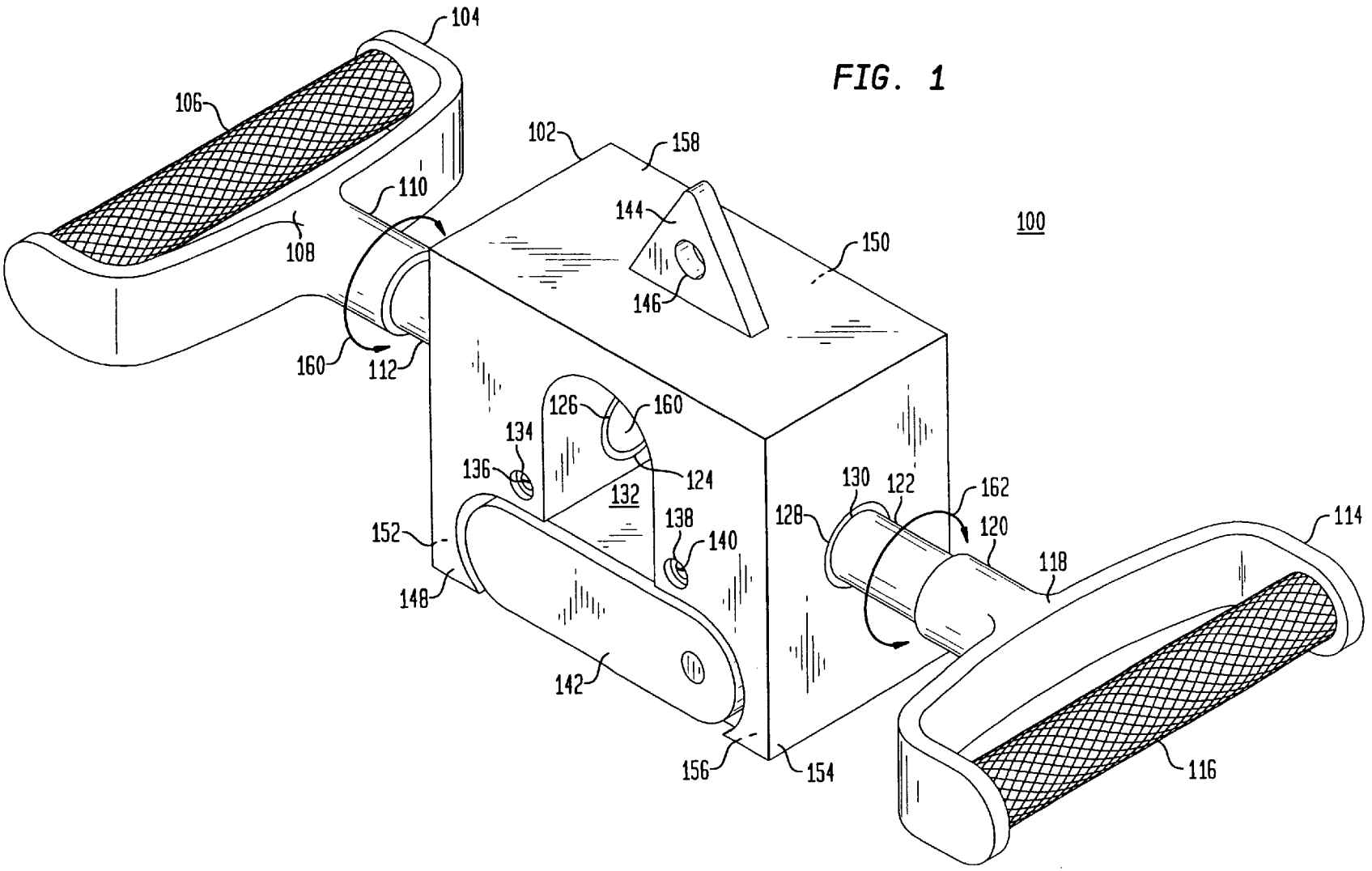
FIG. 1 is a perspective view of a preferred embodiment of an exercise support bar of the present invention.
Figure 2:
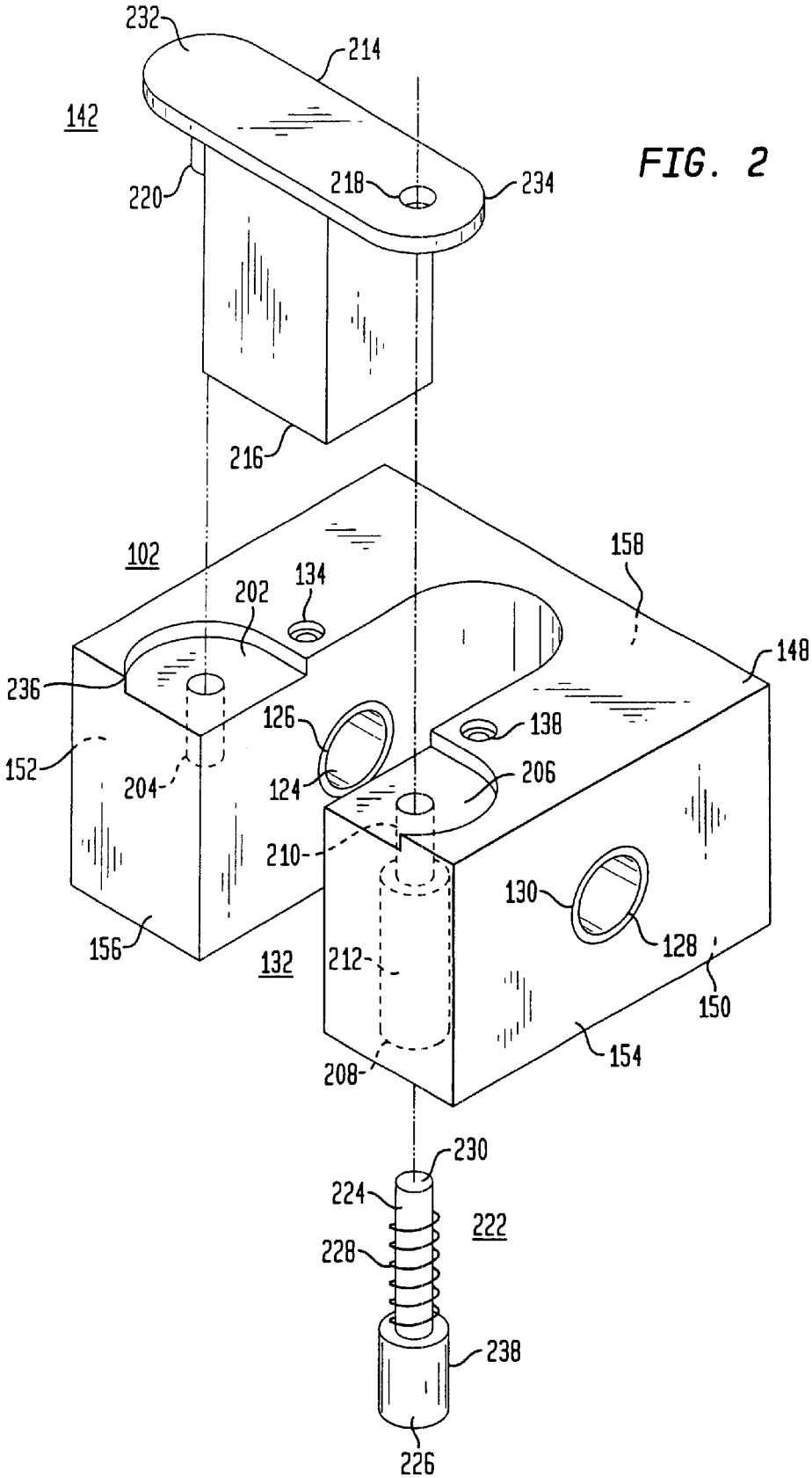
FIG. 2 is a exploded perspective view of a support block.
Figure 3:
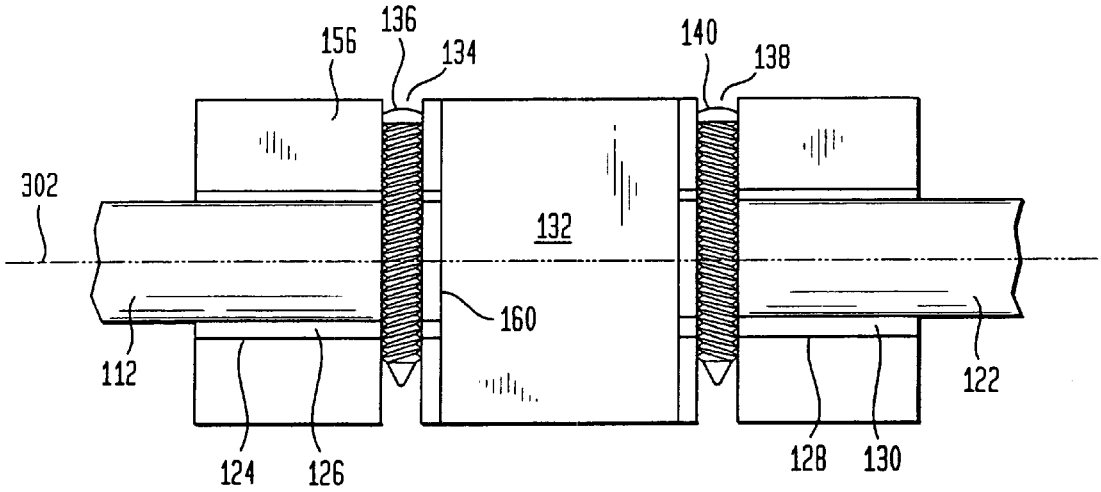
FIG. 3 is a cross-sectional planar view of the connection the shafts of the present invention with the support block.
Figure 4:
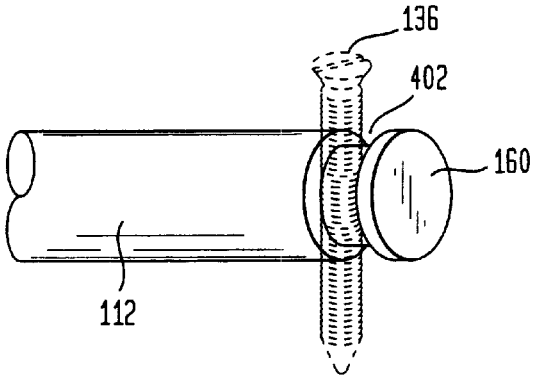
FIG. 4 is a perspective view of a shaft and its connection with the support block.

FIGS. 1–4 illustrate the preferred embodiment of an exercise support bar 100 of the present invention. The exercise support bar 100 comprises a means for removably securing a dumbbell, a first hand grip 104 rotatably connected to a first side 152 of the means for removably securing the dumbbell, and a second hand grip 114 rotatably connected to a second side 154 of the means for removably securing the dumbbell. The preferred means for removably securing the dumbbell is a support block 102 having a top side 148, a bottom side 150, a front side 156, a back side 158, a first side 152, a second side 154, a channel 132 passing through the support block 102 from the top side 148 to the bottom side 150, and a means for removably locking the channel 132. The exercise support bar 100 is preferably made of stainless steel, but this is for convenience purpose only. The exercise support bar 100 of the present invention may be made of any strong material, e.g., metal, composite, and the like, that can withstand the load and stresses of exercising with a dumbbell.

Also in the preferred embodiment, the means for removably locking the channel 132 is a channel door 142 pivotally connected to the support block 102, resulting in the channel door 142 having a closed position and an open position. Specifically, the channel door 142 is generally T-shaped having a top extension 214 and a bottom portion 216. The top extension 214 is rounded on both ends, thereby having a rounded first top extension end 232 and a rounded second top extension end 234. In operation, the channel door 142 closes off the channel 132 in that the channel 132 has an opening through the front side 156 of the support block 102. Therefore, during use, a user inserts the handle of a conventional dumbbell into the channel 132 of the support block 102 wherein the dumbbell is held in place by the user securing the channel door 142 in place in a closed position.

The channel door 142 is pivotally connected to the support block 102 by a spring assembly 222. The spring assembly 222 provides the means for the channel door 142 to be pivotally connected to the support block 102 wherein the channel door 142 can pivot between an open position and a closed position. The spring assembly 222 comprises a pivot pin 238, a spring 228, and a pin aperture 208. In the preferred embodiment, the pivot pin 238 is an elongated shaft having a narrow portion 224 and a thick portion 226, such that the narrow portion 224 of the pivot pin 238 is inserted through the spring 228 and the spring 228 rests on the thick portion 226 of the pivot pin 238. The pin aperture 208 has a shape and dimensions that match the shape and dimensions of the pivot pin 238 and the spring 228, resulting in a narrow pin aperture portion 210 and a thick pin aperture portion 212. The pin aperture 208 passes through the support block 102 from the top side 148 to the bottom side 150. In the preferred embodiment, the narrow portion 224 of the pivot pin 238 is adjacent to the top side 148 of the pivot pin 238 and the thick portion 226 of the pivot pin 238 is adjacent to the back side 150. The pivot pin 238 is positioned such that the narrow portion 224 is rigidly attached to the rounded second top extension end 234 of the channel door 142.

The pivot pin 238 with the spring 228 is inserted into the pin aperture 208 via the thick pin aperture portion 212. The pivot pin 238 is then pressed until the narrow end 230 of the narrow portion 224 protrudes through the pin aperture 208 and through the top side 148 of the support block 102. The narrow end 230 is then rigidly secured, e.g. welded, in a channel door pin aperture 218 located in the rounded second top extension end 234.

In operation, a user simply pushes up on the channel door 142, thereby lifting the channel door 142 via the spring assembly 222. Once in the raised position, the user swings, or pivots, the channel door 142 from the closed position to an open position.

The present invention is described in terms of a support block 102, channel door 142 and spring assembly 222 for convenience purpose only. It would be readily apparent to one of ordinary skill in the relevant art to design and implement a comparable means for removably securing a dumbbell to the exercise support bar 100 and for removably locking the channel 132 of the present invention.

There are two means by which the channel door 142 is secured to the support block 102 in a closed position. The first means comprises a locking knob 220 protruding under the rounded first top extension end 232 of the channel door's 142 top extension 214 and a knob aperture 204 in the support block 102 having the general shape and size of the locking knob 220. The knob aperture 204 is located such that when in the closed position, the locking knob 220 is aligned with the knob aperture 204. Therefore, when in the closed position, the locking knob 220 is held in the knob aperture 204, thereby securing the channel door 142 in the closed position and preventing it from opening.

The second means for securing the channel door 142 in the closed position in the support block 102 functions as a backup safety catch. The second means is a first recessed portion 202 in the top side 148 of the support block 102 having a shape and dimensions that matches and receives the rounded first top extension end 232, and a second recessed portion 206 in the top side 148 of the support block 102 having a shape and dimensions that matches and receives the rounded second top extension end 234. In addition, the support block 102 has a flange 236 on the top side 148 that extends around the rounded first top extension end 232 such that the flange 236 blocks the rounded first top extension end 232 from moving or sliding out of the first recessed portion 202.

Therefore, when in the closed position, the top extension 214 of the channel door 142 fits within the first recessed portion 202 and the second recessed position 206 of the top side 148 of the support block 102. The channel door 142 is secured in place because the locking knob 220 is secure within the knob aperture 204, and is further secured in place by the flange 236. To open the channel door, the user pushes, or pulls, up on the channel door 142, thereby engaging the spring assembly 222, until the top extension 214 clears the first recessed portion 202, the second recessed portion 206, and the top side 148 of the support block 102. Once in the raised position, the user swings, or pivots, the channel door 142 into the open position wherein the pivot point is the pivot pin 238 within the pin aperture 208. The user may leave the channel door 142 in the open position by lowering the channel door 142.

To close the channel door 142, the user again raises the channel door 142 via the spring assembly until the locking knob 220 is above the top side 148 of the support block 102. Once it is raised, the user swings or pivots the channel door 142 back to the closed position then lowers the channel door 142 until the top extension 214 is placed within the first recessed portion 202 and the second recessed portion 206, and the locking knob 220 fits within the knob aperture 204.

In the preferred embodiment, the first hand grip 104 and the second hand grip 114 of the exercise support bar 100 are generally D-shaped having a handle portion 106, 116 and an arched portion 108, 118. The use of a D-shaped hand grip 104, 114 is for convenience purpose only. It would be readily apparent to one of ordinary skill in the relevant art to use a different shaped hand grip 104, 114.

Also in the preferred embodiment, the handle portion 106, 116 of the first hand grip 104 and the second hand grip 114 incorporate a means for improving a user's grip. The preferred means is a plurality of etchings in the surface of the handle portion 106, 116, thereby creating a textured surface, which strengthen the user's grip and assists in the prevention of slippage. In an alternative embodiment, the means for improving the user's grip is a cushion overlaid on top of the handle portion 106, 116, wherein the cushion is made of a rubber, composite, or foam material.

One important feature of the present invention is that the first hand grip 104 is rotatably connected to the first side 152 of the support block 102 by a first shaft 112, as seen by a first arrow 160, and the second hand grip 114 is rotatably connected to the second side 154 of the support block 102 by a second shaft 122, as seen by a second arrow 162. For convenience purpose only, the rotatable connection of the present invention is described in terms of the first hand grip 104. The description is equally applicable to the rotatable connection between the second hand grip 114 and the support block 102.

In the preferred embodiment, the first hand grip 104 is attached to the support block 102 by a first shaft 112. Specifically, the first shaft 112 is fit within a first shaft aperture 124 in the support block 102 extending from the first side 152 of the support block 102 to the channel 132. The first shaft 112 is positioned such that the end 160 of the first shaft 112 is flush with the interior wall of the channel 132. Also, a composite, e.g., plastic, bushing 126 is fit over the first shaft 112 within the first shaft aperture 124 to facilitate the rotation of the first shaft 112 in the support block 102, see first arrow 160.

The first shaft 112 has a groove 402 positioned in proximity with the end 160 of the first shaft 112. Therefore, the means for rotating the first shaft 112 within the first shaft aperture 124 is a first screw 136 that is fixed within the support block 102 extending from the top side 148 to the bottom side 150 via a first screw aperture 134. The first screw 136 is positioned such that the first screw 136 fits within the groove 402 of the first shaft 112. Therefore, the diameter of the first screw 136 is less than the width of the groove 402. This positioning of the first screw 136 allows the first shaft 112 to freely rotate within the first shaft aperture 124 around a longitudinal axis 302, see first arrow 160, without moving or sliding out of the first shaft aperture 124. Operationally, the first screw 136 passes through the bushing 126, resulting in the first shaft 112 to rotate within the bushing 126 in the first shaft aperture 124.

As stated above, the discussion regarding the rotatable connection of the first hand grip 104 to the support block 102 is equally applicable to the rotatable connection of the second hand grip 114 to the support block 102, see second arrow 162, which comprises a second shaft 122 with a groove, a second shaft aperture 128, a second bushing 130, a second screw 140, and a second screw aperture 138.

Also in the preferred embodiment, the exercise support bar 100 incorporates a means for removably attaching the exercise support bar 100 to a pulley weight system. The preferred means is a plate 144, having an aperture 146, rigidly attached, e.g., by welding, to the back side 158 of the support block 102. In operation, a user attaches the exercise support bar 100 to a conventional pulley weight system by hooking the pulley to the plate 144. When finished exercising, the user simply disengages the pulley.

Figure 5:
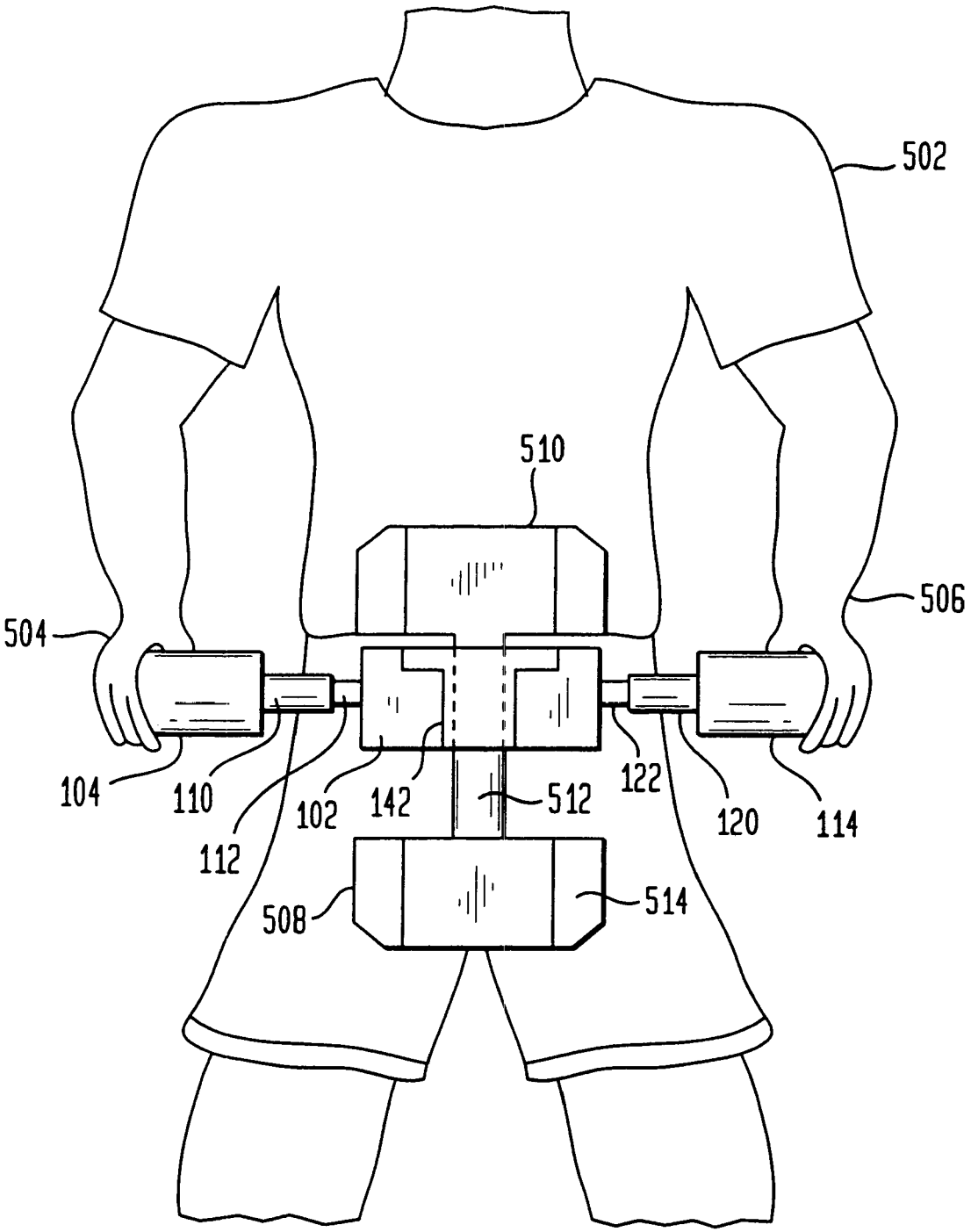
FIG. 5 is a perspective view of a user exercising with the exercise support bar and a conventional dumbbell.
Figure 6:
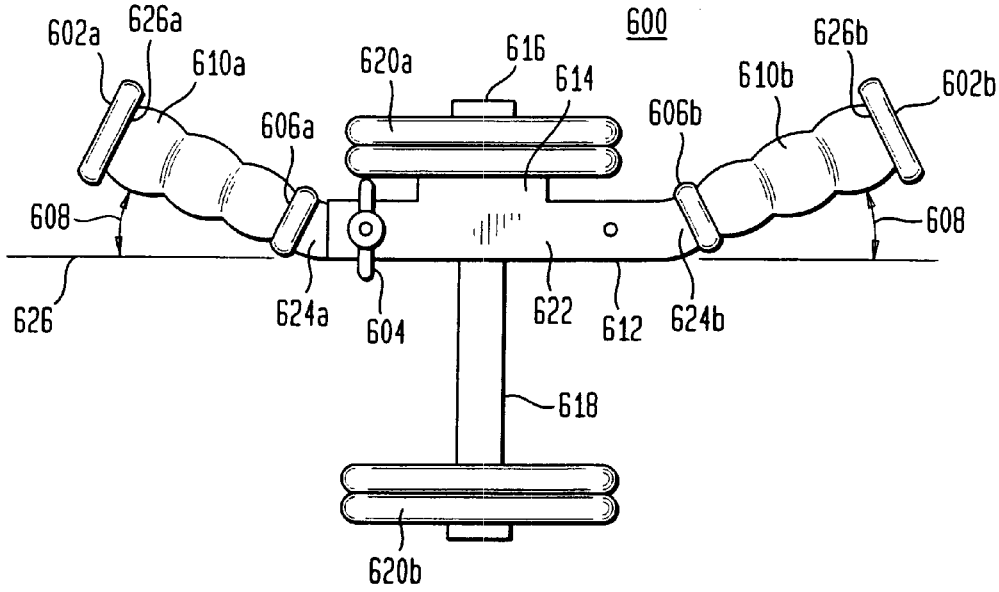
FIG. 6 is a planar side view of an alternative exercise support bar of the present invention.
Figure 7:
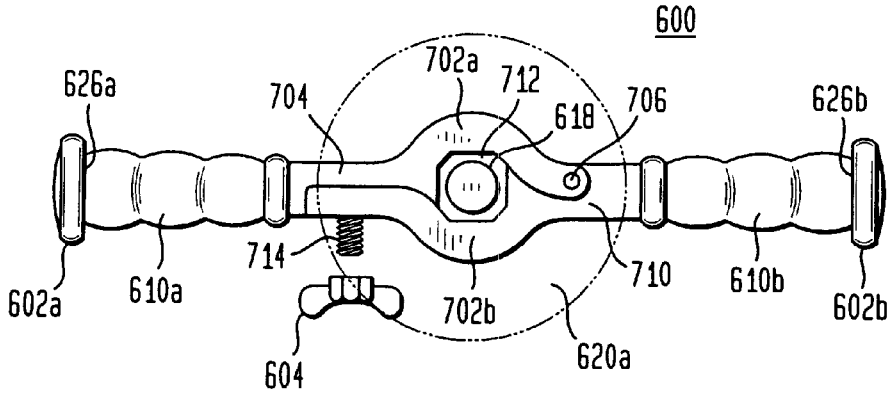
FIG. 7 is a planar top view of the alternative exercise support bar in a closed position holding a conventional dumbbell.

FIG. 5 is a perspective view of a user 502 holding and exercising with the exercise support bar 100 of the present invention using a conventional dumbbell 508. In operation, a user 502 secures a dumbbell 508 in the channel 132 of the exercise support bar 100. Specifically, the user 502 opens the channel door 142 by lifting up on the channel door 142 until the locking knob 220 clears the knob aperture 204 and the top side 148 of the support block 102. Once the channel door 142 is raised, the user 502 swings the locking door 142 into an open position. Next, the user 502 places the handle 512 of the dumbbell 508 into the channel 132 and secures it in the exercise support bar 100 by swinging the channel door 142 into the closed position and lowering the channel door 142 until the locking knob 220 is in the knob aperture 204 and the top extension 214 fits within the first recessed portion 202 and the second recessed portion 206 of the support block 102.

Upon picking up the exercise support bar 100, the dumbbell 508 automatically moves into a vertical position because the first hand grip 104 and the second hand grip 114 are pivotally connected to the support block 102. In the vertical position, the first head 510 of the dumbbell 508 rests on the top side 148 of the support block 102 with the second head 514 suspended below the bottom side 150 of the support block 102. The dumbbell 508 will remain in the vertical position regardless of how the user 502 moves his hands 504, 506, i.e., whether the user 502 raises or lowers his hands 504, 506.

Once the dumbbell 508 is secured in the support block 102, the user 502 holds the handle portion 106 of the first hand grip 104 with a first hand 504 and holds the handle portion 116 of the second hand grip 114 with his/her second hand 506. The user 502 then performs the desired exercise with the exercise support bar 100 wherein the dumbbell 508 rotates freely between the first hand grip 104 and the second hand grip 114. When the exercise is complete, the user 502 may remove the dumbbell 508 from the support block 102 of the exercise support bar 100.

FIGS. 6–9 illustrate an alternative exercise support bar 600 of the present invention. In this embodiment, the exercise support bar 600 comprises an elongated bar 612 having a first section 624*a*, a center section 622 and a second section 624*b*. In the preferred embodiment, the first section 624*a* and second section 624*b* are tilted off the horizontal axis 626 by about fifteen (15) degrees, resulting in a handle angle 608. The use of fifteen (15) degrees is for convenience only. It would be readily apparent for one of ordinary skill in the relevant art(s) to use a different handle angle 608. Furthermore, the design of a first section 624*a*, center section 622 and second section 624*b* is also for convenience only. It would be readily apparent for one of ordinary skill in the relevant art(s) to use a comparable concave shape, or a straight elongated bar 612.

Also in this embodiment, the first section 624*a* comprises a first swivel handle 606*a* and the second section 624*b* comprises a second swivel handle 606*b*. The use of swivel handles 606*a,b* are well known in the relevant arts. It would be readily apparent to one of ordinary skill in the relevant arts to use a swivel handle 606*a,b* or comparable means for rotatably connecting handles to the center section 622. In operation, when a dumbbell 616 is secured within the center section 622 of the exercise support bar 600, the swivel handles 606*a,b* rotate during movement of the exercise support bar 600 to allow natural positioning of the dumbbell 616 throughout the movement. Furthermore, a handgrip 610*a,b* is positioned around each swivel handle 606*a,b* to provide a user with a better grip on the exercise support bar 600. At the distal end 626*a,b* of each swivel handle 606*a,b* a hand stop 602*a,b* is located to prevent a user's hand from slipping during a workout. In the preferred embodiment, the hand grips 610*a,b* are either a rubber coated or a steel surface having an optional textured surface.

The exercise support bar 600 of the present invention also comprises a means for securing a dumbbell 616 in the center section 622. In the preferred embodiment, the center section 622 comprises a top arm 704 and a bottom arm 710 that are pivotally connected to each other via a pivot pin 706 such that the top arm 704 and the bottom arm 710 can be rotated between a closed position and an open position. The top arm 704 and the bottom arm 710 each are shaped with a matching half circle portion 702*a,b* such that when in the closed position, an aperture 712 results in the middle of the center section 622 having a diameter through which the center bar 618 of a dumbbell 616 can pass. The center section 622 also comprises a means for securing the top arm 704 and the bottom arm 710 in the closed position. In the preferred embodiment, the means for securing the top arm 704 and the bottom arm 710 is a bolt 714 and wing nut 604 assembly. The means for securing a dumbbell 616 in the center section 622 of the exercise support bar 600 and the means for securing the top arm 704 and the bottom arm 710 in the closed position are described in these terms for convenience purpose only. It would be readily apparent for one of ordinary skill in the relevant art(s) to design comparable means for securing the top arm 704 and the bottom arm 710, e.g., the use of a clip, fastener, or other interlocking assembly means for securing the top bar 704 and the bottom bar 710.

The center section 622 also comprises a raised portion 614. Specifically, the top half circle portion 702*a* of the top arm 704 comprises one half of the raised portion 614 and the bottom half circle portion 702*b* of the bottom arm 710 comprises the second half of the raised portion 614. Therefore, when the top arm 704 and the bottom arm 710 are in the closed position, the complete raised portion 614 surrounds the aperture 712, thereby providing a raised flat portion on which the weights 620*a* of a dumbbell 616 rest. The raised portion 614 also serves as a spacer between the weights 620*a* of the dumbbell 616 and the wing nut 604 allowing the wing nut 604 complete rotation so it can be easily attached and removed.

In operation, a user removes the wing nut 604 and rotates the top arm 704 and the bottom arm 710 into the open position. After selecting a dumbbell 616 of a desired weight, the user inserts the center bar 618 of the dumbbell 616 into the aperture 712 between the half circle portions 702*a,b* of the top bar 704 and bottom bar 710. The user rotates the top bar 704 and the bottom bar 710 into the closed position with the center bar 618 of the dumbbell 616 passing through the aperture 712. Lastly, the user reattaches the wing nut 604 to the center section 622 to secure the top arm 704 and the bottom arm 710 in the closed position, thereby locking the dumbbell 616 within the exercise support bar 600. The first end weights 620*a* and the second end weights 620*b* of the dumbbell 616 prevent the dumbbell 616 from slipping through the aperture 712. Therefore, the dumbbell 616 is secured within the center section 622 of the exercise support bar 600. To remove the dumbbell 616 from the exercise support bar 600, the user simply removes the wing nut 604, rotates the top arm 704 and the bottom arm 710 into the open position, and removes the dumbbell 616.

Figure 8:
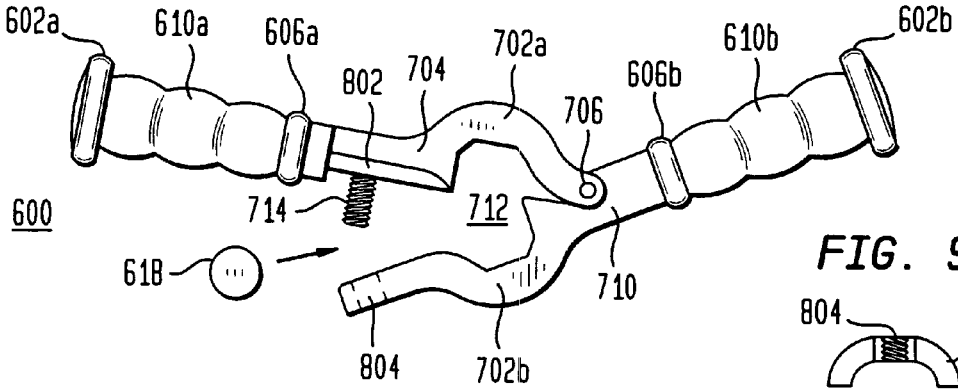
FIG. 8 is a planar top view of the alternative exercise support bar in an open position.
Figure 9:
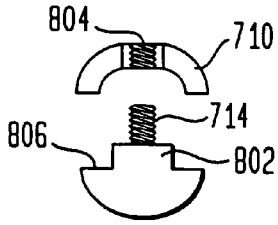
FIG. 9 is a planar side view of an overlay.

FIG. 8 is a planar side view of the exercise support bar 600 with the top arm 704 and the bottom arm 710 of the center section 622 in an opened position. FIG. 9 is a planar side view of an overlay 802 as used with the means for securing the top bar 704 with the bottom bar 710. In these figures, an overlay 802 is incorporated into the top arm 704 above the wing nut screw 806 for added strength and safety of the exercise support bar 600. As described above, to secure the top arm 704 and the bottom arm 710 the two arms 704, 710 are brought together with the wing nut screw 714 passing through the wing nut screw aperture 804 in the bottom arm 710 and secured with the wing nut 604. In this embodiment, the overlay 802 is a male-type component (e.g. a "notch") located in the top bar 704 that fits within a female-type component (e.g. a "groove") 806 located in the bottom bar 710. This male/female component notch-effect provides an additional means for safely securing the top bar 704 and bottom bar 710. That is, if the wing nut 604 loosens or drops off, the overlay 802 is caught via the groove 806, thereby providing a safety catch for the user and preventing the dumbbell 616 from slipping from the exercise support bar 600 and hitting him/her.

CONCLUSION

While various embodiments of the present invention have been described above, it should be understood that they have been presented by the way of example only, and not limitation. It will be understood by those skilled in the art that various changes in form and details may be made therein without departing from the spirit and scope of the invention as defined in the specification and the appended claims. Thus, the breadth and scope of the present invention should not be limited by any of the above-described exemplary embodiments, but should be defined in accordance with the specification and any equivalents.

I claim:

1. An exercise support bar for use with a dumbbell, comprising:

a means for removably securing the dumbbell by operatively coupling with a handle area of the dumbbell, said means having a first side and a second side;

a first hand grip rotatably connected to the first side of said means for removably securing the dumbbell; and a second hand grip rotatably connected to the second side of said means for removably securing the dumbbell;

wherein each of the first and second hand grips rotates about an axis transverse to its longitudinal axis.

2. An exercise support bar for use with a dumbbell, comprising:

a means for removably securing the dumbbell, said means having a first side and a second side;

a first hand grip rotatably connected to the first side of said means for removably securing the dumbbell; and a second hand grip rotatably connected to the second side of said means for removably securing the dumbbell; wherein said means for removably securing the dumbbell comprises:

a support block having a top side, a bottom side, a front side, a back side, and a channel passing through said support block from said top side to said bottom side; and a means for removably locking said channel.

3. The exercise support bar according to claim 2, wherein said channel extends through said front side of said support block and said means for removably locking said channel is a channel door pivotally connected to said support block resulting in said channel door having an open position and a closed position.

4. The exercise support bar according to claim 3, wherein said channel door is generally T-shaped.

5. The exercise support bar according to claim 3, wherein said means for removably locking said channel further comprises a spring assembly for pivotally connecting said channel door to said support block.

6. The exercise support bar according to claim 3, wherein said channel door has a means for securing said channel door in said closed position.

7. The exercise support bar according to claim 6, wherein said means for securing said channel door comprises said channel door having a locking knob and said support block having a knob aperture, wherein said knob aperture is aligned with said locking knob when said channel door is in said closed position.

8. The exercise support bar according to claim 6, wherein said channel door comprises a means for providing a backup safety catch.

9. The exercise support bar according to claim 8, wherein said channel door is generally T-shaped having a rounded first top extension end and said means for providing a backup safety catch is a first recessed portion in said top side of said support block having a shape that matches and receives said rounded first top extension end and said support block has a flange extending around said rounded first top extension end and blocking said rounded first top extension end from moving out of said closed position.

10. The exercise support bar according to claim 2, wherein said first hand grip and said second hand grip are generally D-shaped, said first hand grip and said second hand grip each having a handle portion and an arched portion.

11. The exercise support bar according to claim 10, wherein said handle portion of said first hand grip and said handle portion of said second hand grip incorporate a means for improving a user's grip.

12. The exercise support bar according to claim 11, wherein said means for improving a user's grip is a cushion overlaid on top of said handle portion of said first hand grip and on top of said handle portion of said second hand grip.

13. The exercise support bar according to claim 11, wherein said means for improving a user's grip is said handle portion of said first hand grip and said handle portion of said second hand grip having a textured surface.

14. The exercise support bar according to claim 2, wherein said first hand grip is rotatably connected to said first side of said means for removably securing the dumbbell by a first shaft rotatably passing through a first shaft aperture in said support block, and said second hand grip is rotatably connected to said second side of said means for removably securing the dumbbell by a second shaft rotatably passing through a second shaft aperture in said support block.

15. The exercise support bar according to claim 2, further comprising a means for removably attaching the exercise support bar to a pulley weight system.

16. The exercise support bar according to claim 15, wherein said means for removably attaching is a plate, having an aperture, rigidly attached to said means for removably securing the dumbbell.

17. The exercise support bar according to claim 2, wherein the exercise support bar is made of metal.

18. A method for exercising using an exercise support bar and a dumbbell, the method comprising the steps of:

(a) securing the dumbbell in the exercise support bar, the exercise support bar having a means for removably securing a dumbbell, said means having a first side and a second side, a first hand grip rotatably connected to said first side of said means for removably securing the dumbbell, and a second hand grip rotatably connected to said second side of said means for removably securing the dumbbell;

(b) holding said first hand grip;

(c) holding said second hand grip; and (d) exercising with the exercise support bar wherein the dumbbell rotates freely between the first hand grip and the second hand grip.

19. The method according to claim 18, further comprising:

(e) removing the dumbbell from the exercise support bar.

20. An exercise support bar for use with a dumbbell, comprising:

an elongated bar having a horizontal axis, a first section, a center section, and a second section;

a means for removably securing the dumbbell in said center section of said elongated bar; and a means for swiveling the dumbbell around the horizontal axis of said elongated bar.

21. The exercise support bar according to claim 20, wherein said first section and said second section are bent off of said horizontal axis, resulting in a handle angle.

22. The exercise support bar according to claim 21, wherein said handle angle is about 15 degrees.

23. The exercise support bar according to claim 20, wherein said means for swiveling comprises:

a first swivel handle positioned on said first section of said elongated bar; and a second swivel handle positioned on said second section of said elongated bar.

24. The exercise support bar according to claim 23, wherein a first hand grip is positioned around said first swivel handle and a second hand grip is positioned around said second swivel handle.

25. The exercise support bar according to claim 24, wherein said first hand grip and said second hand grip comprise a means for improving a user's grip.

26. The exercise support bar according to claim 23, further comprising:

a first hand stop positioned at a distal end of said first swivel handle; and a second hand stop positioned at a distal end of said second swivel handle.

27. The exercise support bar according to claim 20, wherein said means for removably securing the dumbbell comprises:

said center section having a top arm, a bottom arm, and an aperture;

a means for pivotally connecting said top arm and said bottom arm wherein said top arm and said bottom arm can be rotated between an open position and a closed position such that when in said closed position, said top arm and said bottom arm form said aperture; and a means for securing said top arm and said bottom arm in the closed position.

28. The exercise support bar according to claim 27, wherein said center section further comprises a raised portion.

29. The exercise support bar according to claim 27, wherein said means for securing said top arm and said bottom arm in the closed position comprises a wing nut.

30. The exercise support bar according to claim 27, wherein said means for securing said top arm and said bottom arm comprises an overlay having a male component and a female component.

* * * * *